US008523065B1

(12) United States Patent
Wade et al.

(10) Patent No.: US 8,523,065 B1
(45) Date of Patent: Sep. 3, 2013

(54) METHOD AND APPARATUS FOR RECYCLING RFID TAGS FOR DISPOSABLE CUPS

(75) Inventors: Jeremy L. Wade, Bradenton, FL (US); Gregory M. Edelson, Charlotte, NC (US)

(73) Assignee: Validfill, LLC, Sarasota, FL (US)

( * ) Notice: Subject to any disclaimer, the term of this patent is extended or adjusted under 35 U.S.C. 154(b) by 0 days.

(21) Appl. No.: 13/341,309

(22) Filed: Dec. 30, 2011

Related U.S. Application Data

(60) Provisional application No. 61/428,493, filed on Dec. 30, 2010, provisional application No. 61/488,366, filed on May 20, 2011.

(51) Int. Cl.
*B65B 1/30* (2006.01)

(52) U.S. Cl.
USPC ..... 235/381; 141/94; 141/95

(58) Field of Classification Search
USPC ..... 235/381; 141/94, 95
See application file for complete search history.

(56) References Cited

U.S. PATENT DOCUMENTS

| | | | | |
|---|---|---|---|---|
| 4,316,533 | A * | 2/1982 | Hughes et al. | 194/213 |
| 8,245,739 | B1 * | 8/2012 | Wade et al. | 141/94 |
| 2005/0087255 | A1 * | 4/2005 | Humphrey et al. | 141/94 |
| 2007/0215239 | A1 * | 9/2007 | Dorney | 141/94 |
| 2010/0147417 | A1 * | 6/2010 | Dorney | 141/95 |

* cited by examiner

*Primary Examiner* — Daniel Hess
(74) *Attorney, Agent, or Firm* — Buchanan Ingersoll & Rooney PC

(57) ABSTRACT

We provide a system and method for temporarily coupling a beverage purchase with an RFID tag or other media, then recovering the RFID tag or other media for reuse after the beverage has been dispensed. Media may be, for example, but are not limited to cards (including plastic, cardboard, or paper cards), keychains, or key fobs.

11 Claims, 12 Drawing Sheets

User Flow for Programmable Cards to Dispense Beverage

Drawing of beverage dispenser with antennas and card slots located above each dispensing head.

Drawing of single head dispensing machine with card slot located near the pour button.

Drawing of beverage dispenser with antennas and card slots located above each group of dispensing head.

Screen Selection

Screen B – Picture to Place Cup on Tray

Figure 7

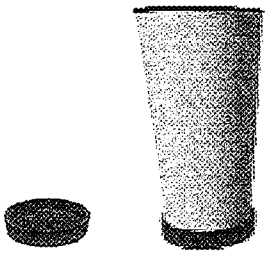

A. A poly propylene "boot" with an embedded RFID tag in reusable and the trigger to activate the dispenser

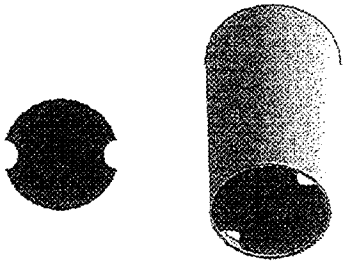

B. A "token" that is placed on the bottom of the cup at the point of sale by the employee

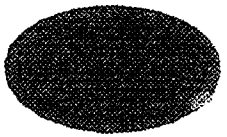

C. The retailer controls the boots or tokens or have them activated at the register by passing them over an RFID activator

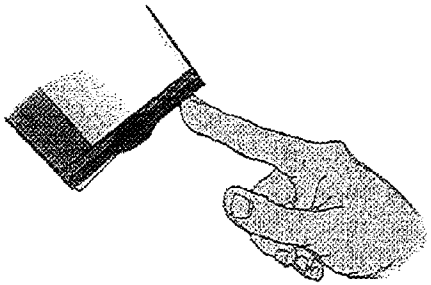

D. The boot or token is removed after the pour and recycled for reuse. A pivot design on the makes removal easy

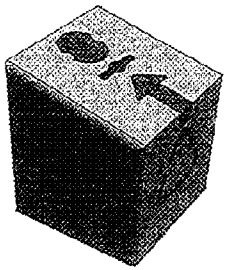

E. The trigger devices are recycled in branded boxes next to the dispensers and trash cans. A reader can be added to the box to scan the boot or token as it is returned.

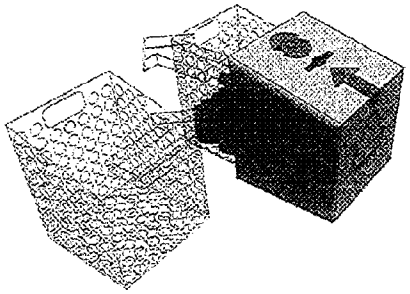

F. The trigger devices are collected in a dishwasher safe basket that is replaced as the trigger devices go through the same cleaning process as food trays

*Figure 10b*

Graphic User Interface Message Selection

1.FILLING (X) OF (Y) DRINKS
2.UNLIMITED REFILLS UNTIL XX/XX/XX
3.UNLIMITED REFILLS FOR THE NEXT XX MINUTES
4.NO REFILLS LEFT, SEE CASHIER
5.PLACE CUP ON TRAY
6.NEXT REFILL IN XX MINUTE(S) XX SECONDS
7.FILL COMPLETE
8.SOLD OUT – PLEASE SELECT ANOTHER BEVERAGE
9.INVALID CUP
10.PLACE CUP ON TRAY THEN DISPENSE FOR CUP INFO
11.CUP INFORMATION
12.X REFILLS REMAINING FOR XX MINUTES

Background Screen Selection

A.Main Screen
B.Animation; placing a cup on tray
C.Secondary screen
D.Secondary screen, message on right, possible cup filling on left
E.Secondary screen, message center

METHOD AND APPARATUS FOR RECYCLING RFID TAGS FOR DISPOSABLE CUPS

CROSS-REFERENCE TO RELATED APPLICATIONS

This application claims priority to U.S. Provisional Patent Application No. 61/428,493, filed on Dec. 30, 2010, and to U.S. Provisional Patent Application No. 61/488,366, filed on May 20, 2011. Both of those applications are incorporated by reference herein.

BACKGROUND OF THE INVENTION

1. Field of the Invention

Embodiments of the invention relate methods, systems, and apparatus for temporarily associating beverage distribution with RFID devices.

2. Description of the Related Art

Systems exist for providing a cup or other beverage container with an RFID device, then using that RFID device to monitor such things as permitted numbers or volumes of beverage fills, or of customer preferences associated with the user or owner of the beverage container. For example, U.S. Pat. No. 7,617,850 provides a system and method for actuating valves of a dispensing system to dispense a beverage into a container based on information obtained from an RFID tag coupled to a beverage container. U.S. Pat. No. 7,617,850 is incorporated by reference herein.

Unfortunately, given the relatively high price of RFID tags, it may be impractical to perform the method of the U.S. Pat. No. 7,617,850 or other similar methods in environments where beverage containers are only used once. This includes, for example, in quick service restaurants, convenience stores, highway rest stops, and the like.

BRIEF SUMMARY OF THE INVENTION

It would be desirable to provide a system and method for temporarily coupling a beverage purchase with an RFID tag or other media, then recovering the RFID tag or other media for reuse after the beverage has been dispensed. This would reduce the cost of using the RFID tags over time. Embodiments of the invention provide a token that includes an RFID tag or other media that may be used to indicate the purchase of a beverage. Tokens may be, for example, but are not limited to cards (including plastic, cardboard, or paper cards), keychains, key fobs, or personally wearable devices, such as bracelets.

In other embodiments of the invention the RFID tag or other media is also temporarily associated with a card, lanyard or identification bracelet of a user, so that the use of the temporary tag may be monitored and, if necessary, its return verified.

DETAILED DESCRIPTION OF THE FIGURES

In the accompanying drawings I have shown certain present preferred embodiments of our method and apparatus for recycling RFID tags for disposable cups in which:

FIG. 3(*b*) shows a beverage dispenser with antennas and card slots located above two separate groups of dispensing heads.

Figure 5A:
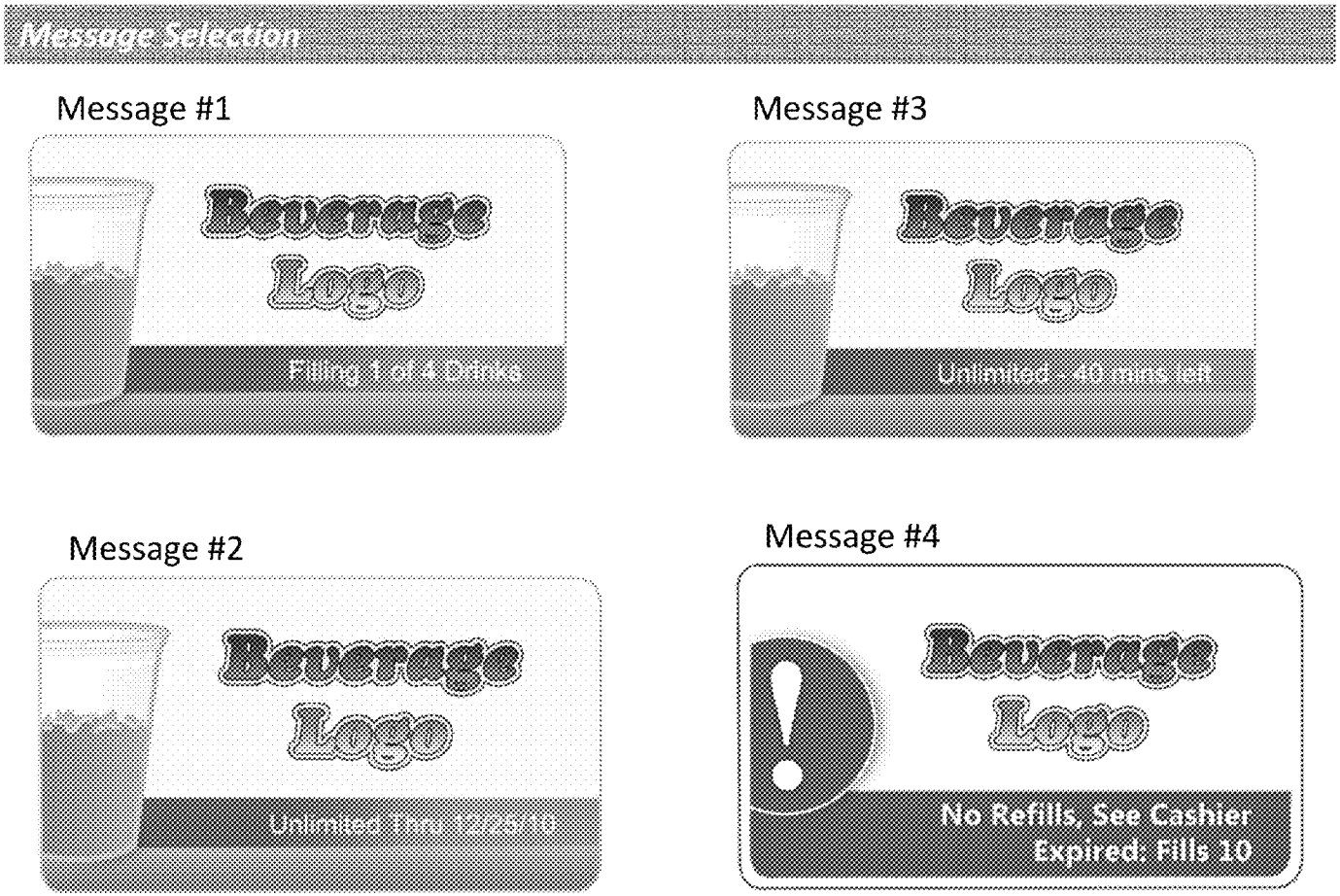
Figure 5B:
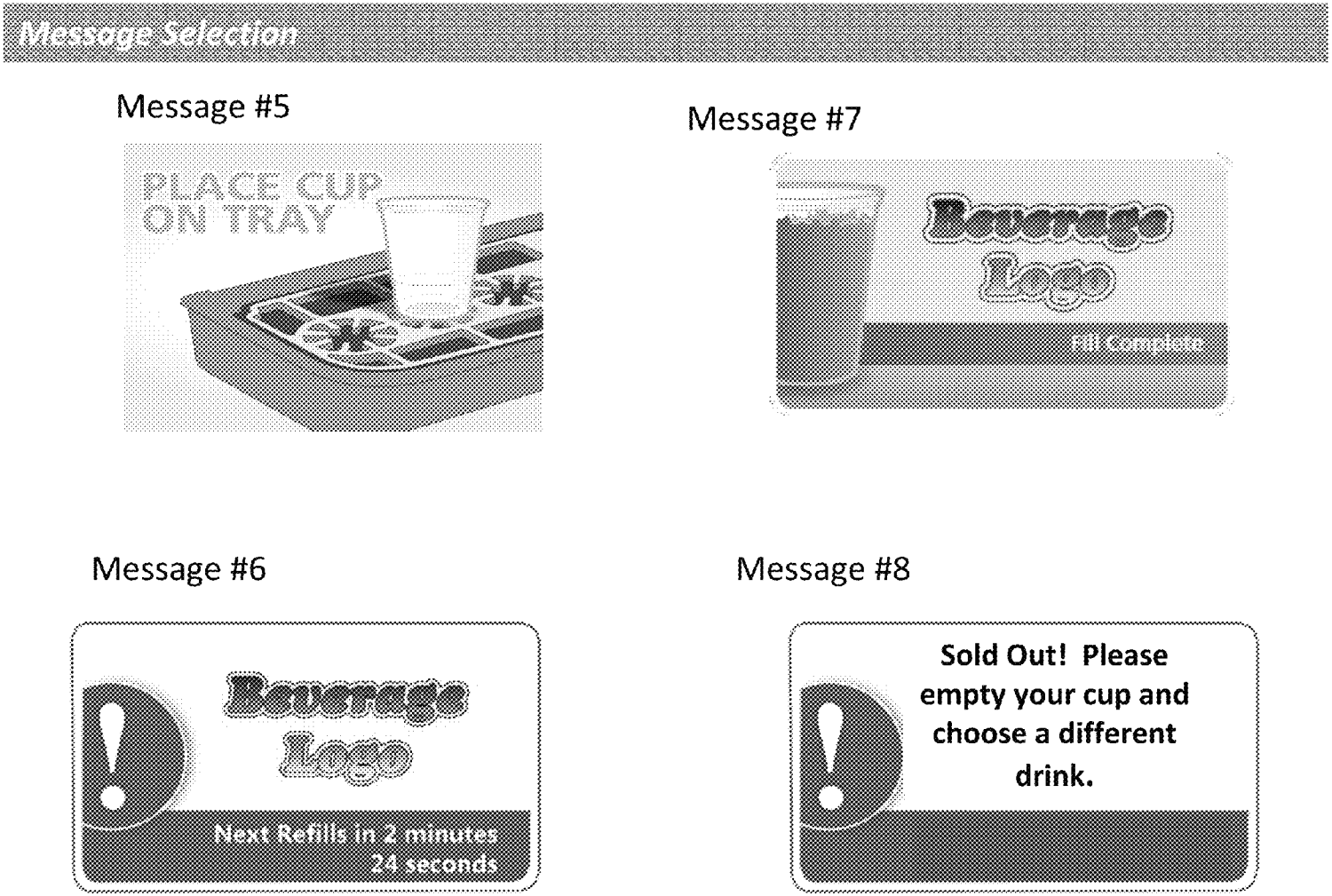

FIGS. 5(*a*) and 5(*b*) show multiple examples of informational messages that may be provided if the beverage distribution is coupled with a display.

Figure 6:
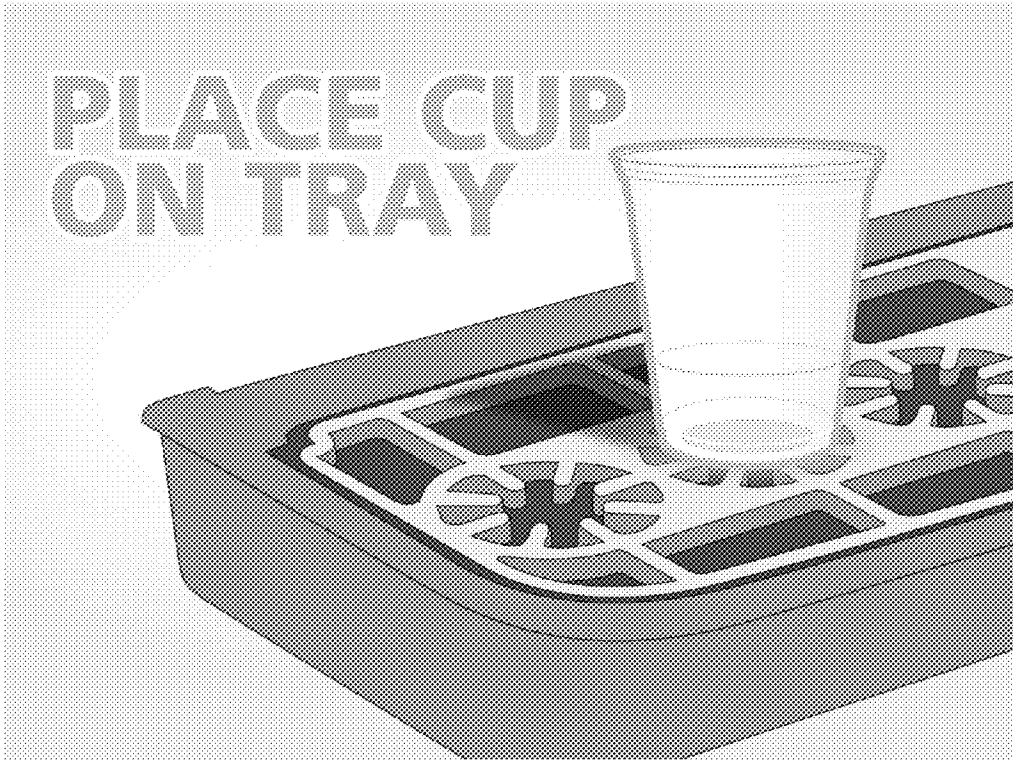

FIG. 6 shows another informational message that may be displayed on a touch screen associated with a beverage dispenser.

FIG. 7 shows embodiments of the invention as applied to cups typically found in quick-service restaurants.

Figure 8:
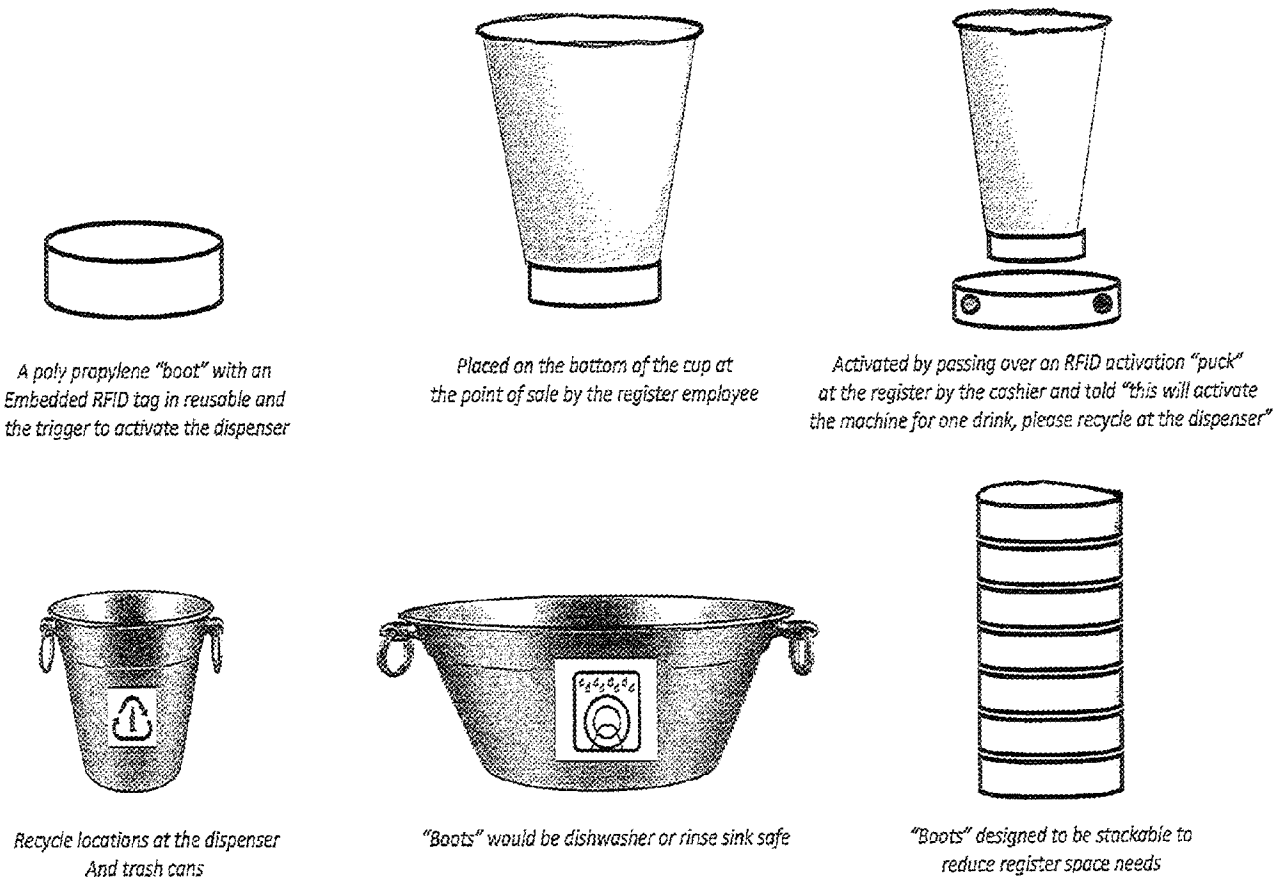

FIG. 8 shows a further embodiment of the invention.

Figure 9:
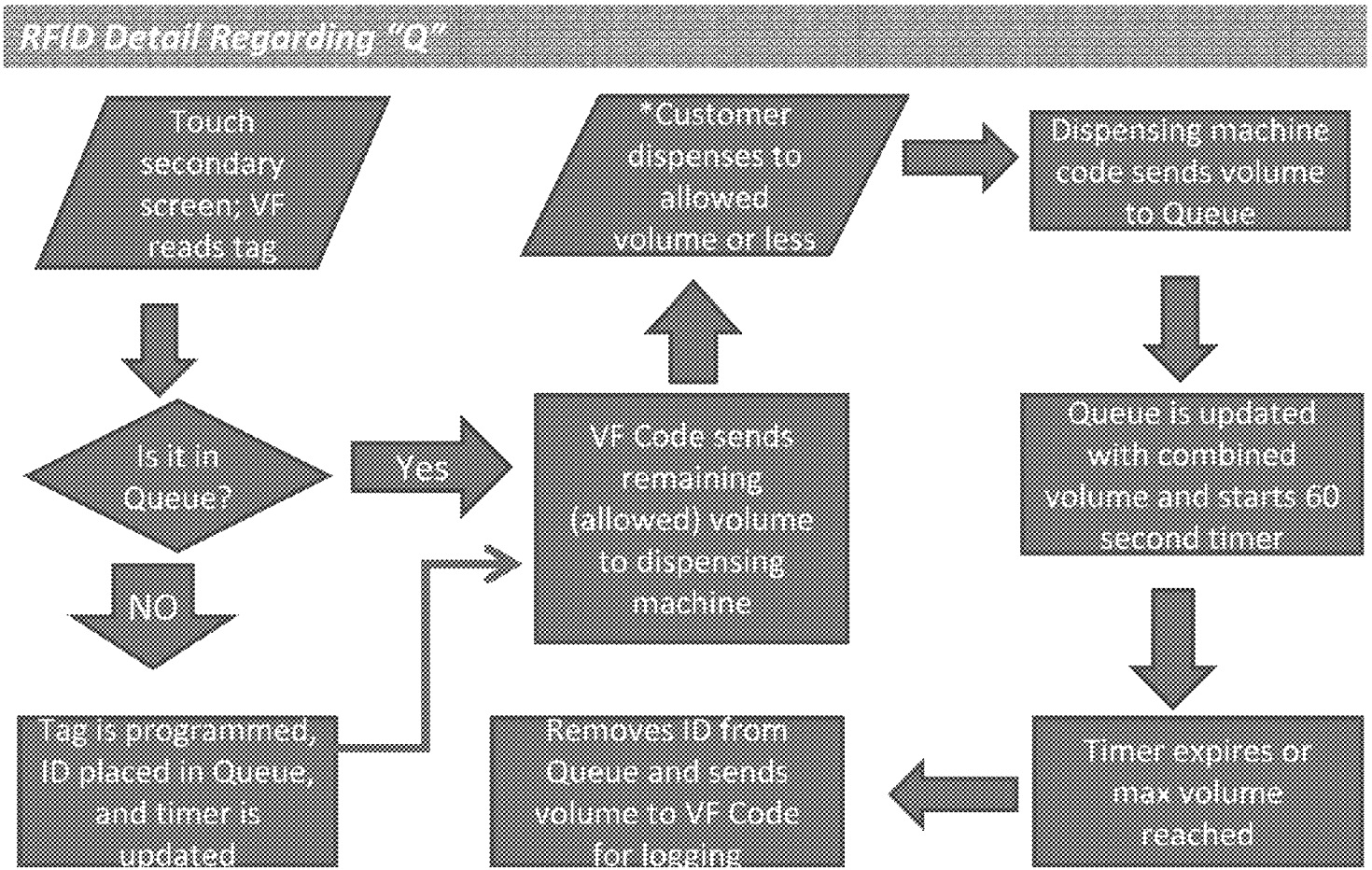

FIG. 9 shows an flow chart that details an embodiment of the invention.

Figure 10A:
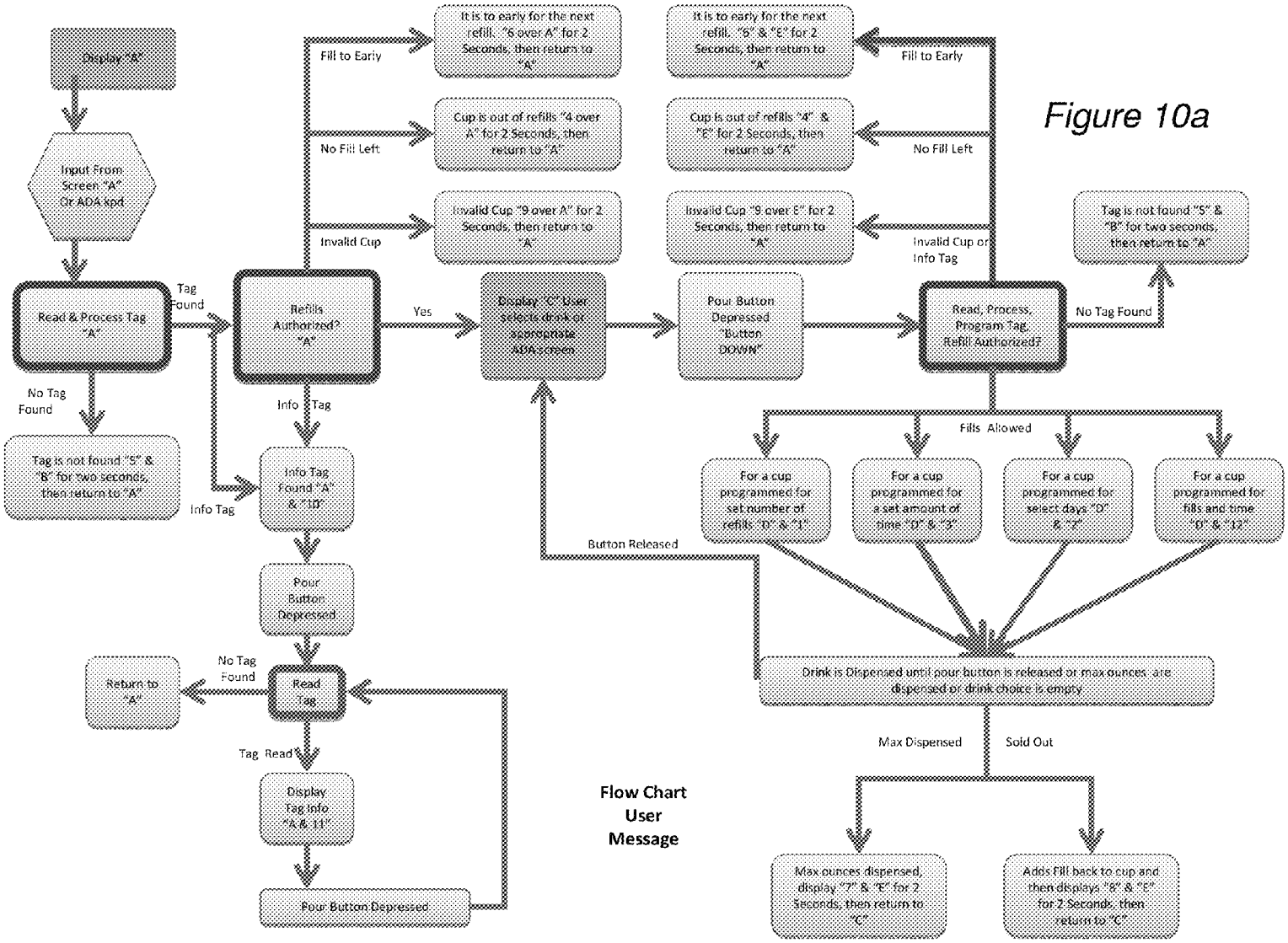

FIG. 10(*a*) show a flow chart that details displays that are presented during the steps of an embodiment of the invention.

FIG. 10(*b*) shows messages and screen selections that are displayed during the process steps of the flow chart shown in FIG. 10(*a*).

DETAILED DESCRIPTION OF THE INVENTION

Embodiments of the invention provide systems, methods, and apparatus for temporarily associating an RFID tag or other media to a beverage purchase. Although further embodiments of the invention will be described in the terms of RFID tags, it will be understood that these embodiments also contemplate the use of other media such as, for example, barcodes, including bokodes or two-dimensional barcodes, or magnetic strips. RFID tags may be ultra-high frequency (UHF) RFID tags or high frequency (HF) RFID tags. Media that may not be altered to include new information may instead be replaced by other media when the need to update arises.

Typically the beverage purchase is intended to be dispensed in a disposable beverage container, though that is not required. Beverage containers may be, for example, but are not limited to, plastic, paper, or cardboard containers.

Figure 1:
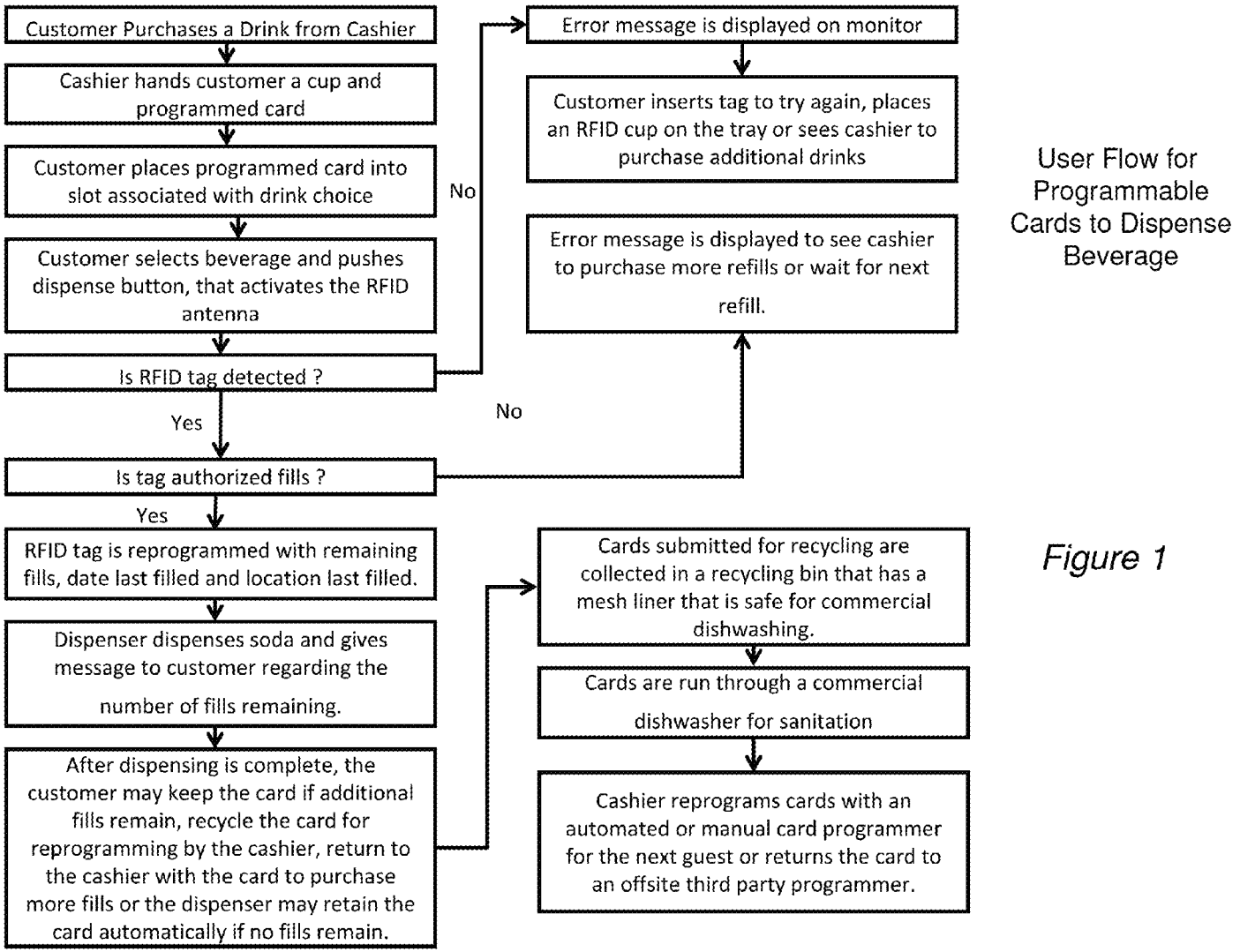
FIG. 1 shows a flow chart detailing an embodiment of the invention.

A preferred embodiment of the invention may be better understood with reference to the figures. FIG. 1 shows a flowchart of a typical use of the system of the invention. As shown in that embodiment, a customer purchases a beverage. Upon purchase of a beverage the customer is given an RFID tag written with information that includes the parameters of the beverage purchase. The tag may be written at the time of purchase or may be prepared in bulk prior to their sale. These parameters may include, for example, the number of beverages that are purchased, the volume of beverage purchased, or the time during which beverage refills are permitted. In a preferred embodiment the RFID tag is on or embedded in a card.

In another embodiment an object including an encapsulated RFID tag will be provided. These objects may be affixed to or otherwise coupled to a beverage container. Objects may have many shapes, and may be affixed in a number of ways. For example, in one embodiment a plastic or paper "boot" is used, as shown in FIGS. 7 and 8. In another embodiment a token is used; this token may be wedged in the bottom of the beverage container as shown in FIG. 7. In a further embodiment the object may be a sleeve that fits around a cup. For example, the sleeve may be paper or plastic. In a still further embodiment the object may be clipped to the rim of the container; the clipped object may be innocuous or it may be ornamental, and a user may be provided with the option to retain the clipped object rather than recycling it as described below. In a yet still further embodiment the object may be designed to fit into a specially-designed, conforming recess on the side or bottom of the beverage container. The recess or the object may include a tab or other device that allows the object to be retained by the tab or by an interference fit until the user wishes to remove the object. This object may also be referred to as a "security device."

Figure 2:
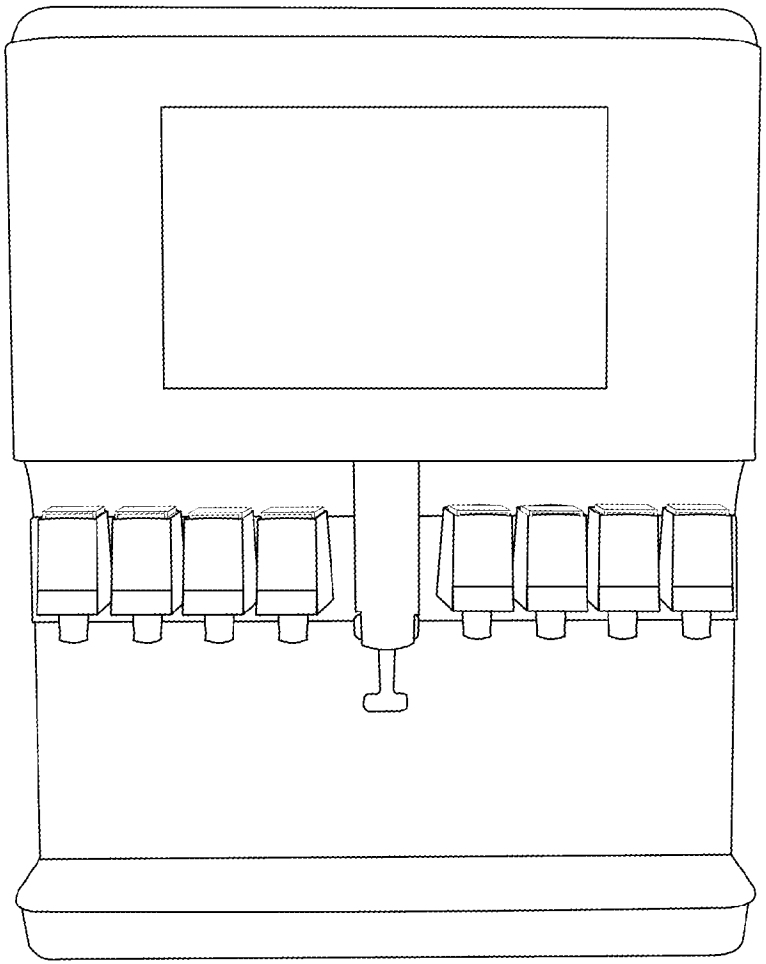
FIG. 2 shows a beverage dispenser with antennas and card slots located above each dispensing head.
Figure 3A:
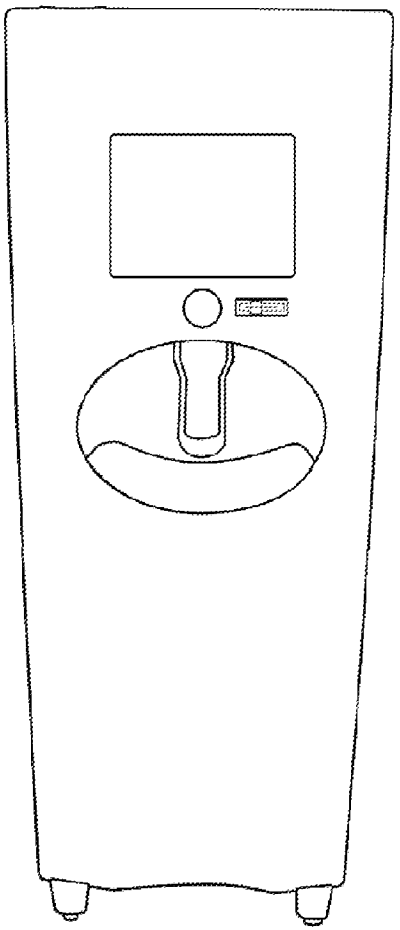
FIG. 3(*a*) shows a single-head dispensing machine with a card slot located near the pour button.
Figure 3B:
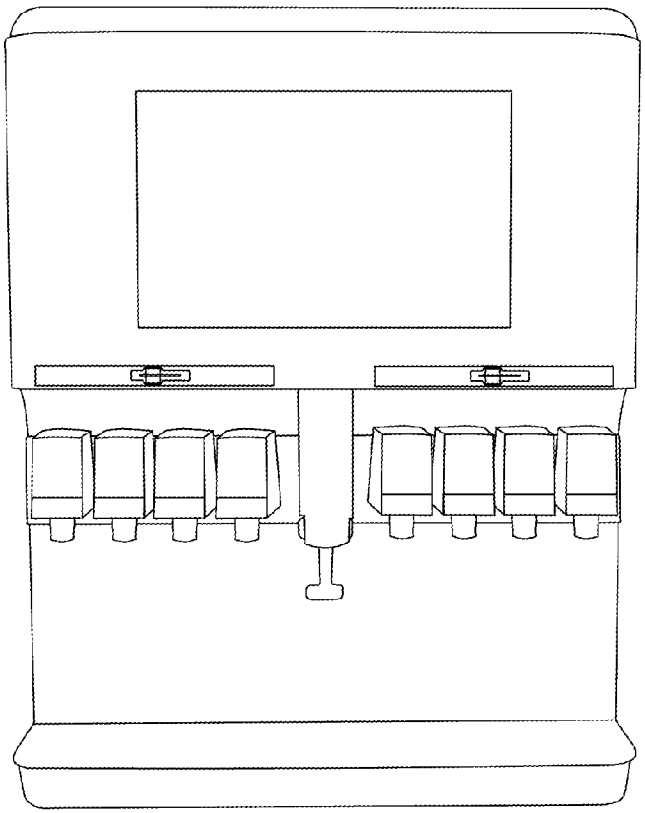
Figure 4:
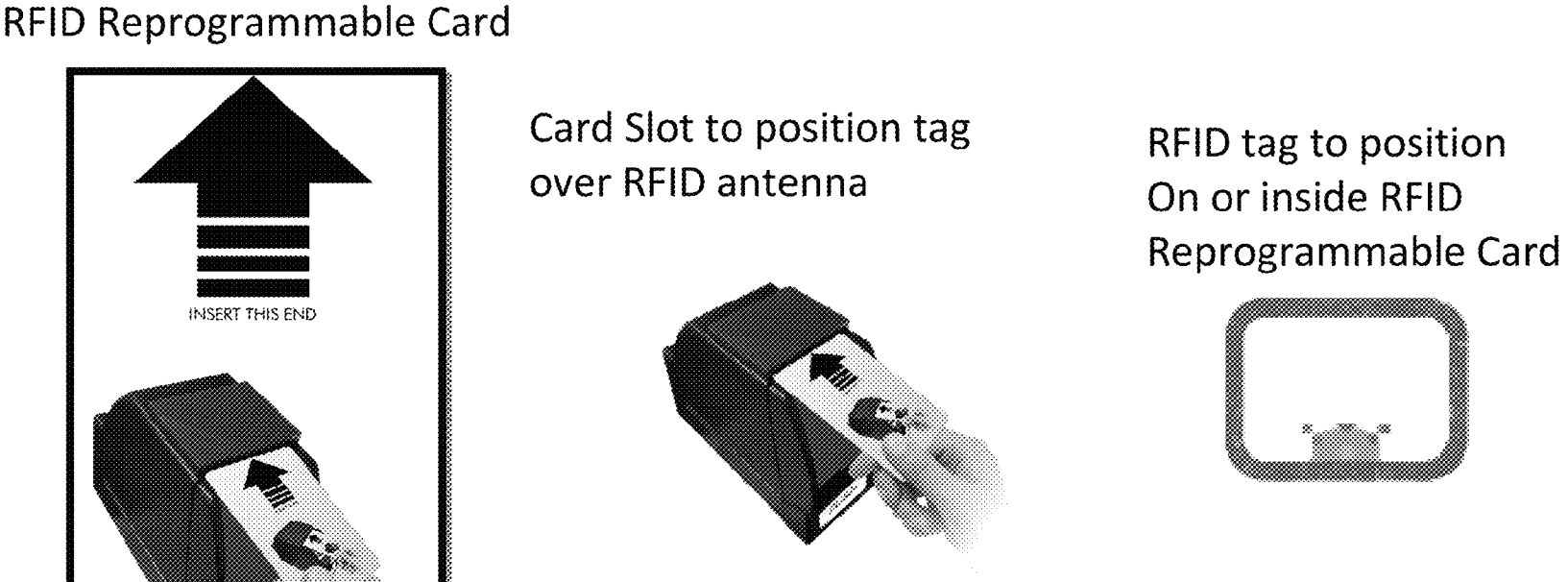
FIG. 4 shows a RFID programmable card that may be used in one embodiment of the invention.

Once in possession of the RFID tag the customer proceeds to a beverage dispenser, selects a beverage, and places the programmed card into a reader associated with the customer's beverage choice. Typically the dispenser includes one or more monitors that may be touch-sensitive. The reader is associated with an antenna. FIGS. 2, 3(*a*), and 3(*b*) show various beverage dispensers that may be used with embodiments of the invention. Readers and antennas may be provided in various combinations with the beverage dispensers. For example, a single head dispenser may be associated with one card slot antenna, or with one card slot antenna and one tray antenna. This may allow a customer to access the dispenser in multiple ways; for example, a single beverage dispenser may be equipped with hardware that allows customers with both refillable, RFID-enabled mugs and customers with recyclable RFID cards to obtain beverages from the same dispenser.

A multiple head dispenser may include one or more card slot antennas, each controlling one or more dispensing heads. A multiple head dispenser may also include one or more card slot antennas controlling one or more dispensing heads, along with one or more tray antennas controlling one or more dispensing heads. Allowing multiple dispensers to be controlled by more than one slot/antenna combination allows multiple customers to access different dispensing heads on the same beverage dispenser, either simultaneously or with minimum delay between beverage pours.

Following beverage selection the customer activates an actuator (which may include a real or virtual button or lever) to activate an antenna associated with the same dispensing head associated with the actuator. If an RFID tag is not detected, the monitor associated with the beverage dispenser displays an error message that, for example, may invite a customer to make another attempt at detection of the RFID tag by the dispenser before requesting assistance from an attendant.

If the antenna detects an RFID tag, the tag is analyzed to determine if a beverage fill is authorized. If no fill is authorized, the monitor displays instructions to either purchase an additional refill if a beverage is desired or, if the refills are distributed in timed increments, to wait for a certain period of time for another fill.

If, however, a fill is authorized, beverage is dispensed. The RFID tag is reprogrammed with information that may include, for example, number or volume of remaining fills, date of last fill, and location of last fill. The customer is then informed of the number of fills remaining.

If no further fills are authorized the monitor may inform the customer that the value of the RFID tag has been exhausted. The customer may then be invited to recycle the card for reprogramming. They may also be invited to return the card to a cashier to purchase more beverage fills or an additional period of time in which fills are authorized.

The vendor may realize substantial convenience and savings from recycling of the tag. For example, tags (whether on cards, fobs, or other instrumentalities) may be collected in a bin that is suitable for insertion into a commercial dishwasher, allowing the tags to be sanitized prior to use by another customer. Of course, the tags may also be sanitized by UV light sanitation or by hand washing.

After recycling the tag may be reprogrammed by automated or manual means. In some embodiments the cards may be reprogrammed by an automated feed. In another embodiment they may be reprogrammed when returned to the recycling bin. In a further embodiment the card may be retained by the slot in the dispenser when the data indicates that no further fills are available; the card may be sanitized and/or reprogrammed after it is retained. In some embodiments the card is disposable; this embodiment is particularly preferred when the invention is used with a bar code rather than an RFID tag.

As already noted, in some embodiments of the invention at least one display is coupled to the beverage dispenser and able to provide advertisements and/or status information to a user of the dispenser. In some embodiments a static background is presented and different messages appear on the foreground depending on the actions of the consumer. As shown in FIG. 5(*a*), a number of messages may be displayed to set forth the status of the card as it relates to time or number of remaining fills. FIG. 5(*b*) demonstrates a number of instructional, informational, or "error" messages that may be used. FIG. 6 shows an example of an instructional message that may appear on the screen. This display may have touch and multi-touch functionality, and may be used as an actuator in one or more embodiments.

It should be noted that in some cases for convenience or accessibility beverage dispensers may be equipped with audio cues that that provide information that is identical to, similar to, or supplementary to the information that is displayed on the screen. In other embodiments various messages on the screen may be overlaid to provide a customer with an indication of the priority of any given message relative to others that are being presented.

In a further embodiment the RFID tag may be authorized for beverage distribution and also associated with another identification tag worn, carried, or otherwise associated with a user. That user would then be able to be accountable for safe return of the RFID tag and associated device. If the RFID tag is not returned, then the user's account could be charged a fee. This would also allow tracking of the purchasing habits of the user, even when the user is relying on disposable beverage containers. This information may further be used to provide advertising to the consumer.

Those of skill in the art will recognize that the card readers in the beverage dispensers may have multiple uses. For example, they may allow a beverage dispenser to service both customers with prepaid dispensation cards and customers who wish to pay for a beverage by stored value or through a credit card. The tags and beverage distribution may also be associated with a customer loyalty card and/or program.

Systems such as those described herein may enjoy multiple advantages depending on the embodiment. First, waste is reduced because the RFID tags may be repeatedly reused. Second, rather than pay for an unending stream of RFID tags, the vendor distributing the beverage only needs to keep on hand a number of tags equal to the number of customers who will be using a beverage container at any given time, taking into account the time necessary to clean and reuse the RFID tags as well as the possibility that some users may inadvertently dispose of or retain the tags (which would be rendered inoperative after dispensing the originally-coded amount of beverage), or that some of the tags may break.

The return receptacles for the RFID tags may also include an indicator to show the customer that the return of the tag has been logged. This indicator could be, for example, a light. In another embodiment the customer may not be made aware that the tag has been returned, even if the return is logged. Providing a customer with an incentive to return the tag will also encourage prompt return of the tag, which will provide more accurate information on the time that the customer spent between his or her purchase of the beverage and departure from the place of purchase (or, in the alternative, from the time of purchase to the time that a beverage is dispensed, if the customer immediately returns the tag).

FIG. 7(*a*) shows one embodiment of the invention, a "boot" with an embedded RFID tag. In this embodiment the boot is polypropylene. A further embodiment is shown in FIG. 7(*b*), which presents a token that may be placed on the bottom of the cup at the point of sale. The token may be activated at the point of sale or prior to sale, and, optionally, may have lights or other indicators showing that the token is authorized to permit distribution of a beverage from a reader-equipped dispenser.

As shown in FIG. 7(*d*), after the completion of the pour and consumption of the beverage, the token may be removed from the beverage container. An optional pivot design may facilitate removal of the token from the beverage container. FIG. 7(*e*) shows use of a branded box to recycle the token, though of course other recycling collection methods may be used. Following collection the token may be washed, preferably in a dishwasher and at the same time as the washing of trays and other restaurant implements. This will add only a marginal water and energy cost that is far outweighed by the savings that results from reuse of the RFID tags.

FIG. 8 shows a further embodiment of the invention. In FIG. 8, a boot includes an RFID tag and is placed on the bottom of a cup at the point of sale. The RFID tag may be pre-activated or may be activated at the time of sale. The boot may be recycled and washed as described above. For further convenience, the boots may be stackable, allowing them to be compactly placed in a storage area or in a dispenser.

FIG. 9 shows a flow chart that details an embodiment of the present invention. The system described by the flowchart may exist based on a hardware configuration or a software configuration. Further, a software configuration may exist on and be portable on any form of non-transitory computer readable medium or memory, including but not limited to hard drives, CDs, DVDs, ROM, RAM, and DRAM.

According to FIG. 9 a user may interact with the system based on a display screen that may consist of a touch screen, or other user interface. A user may touch the display screen to active the system which then reads the identification information on an RFID tag. The system detects whether the information of the RFID is stored in its system. The storage mechanism may consist of a queue structure. If the information stored on the tag is not in the system, the RFID tag is programmed, the identification information of RFID tag is placed in the queue, and a system timer associated with the identification information is updated. Once the RFID information is found in the queue, the system sends information to a dispensing machine. Additionally, a VF code section of the system may send the information to the dispensing machine.

The dispensing machine receives this information, which typically consists of data regarding the amount of volume of drink that is allowed to be dispensed with the particular RFID tag, and a user is able to dispense the allowed volume or less of beverage fluid. The dispensing machine then sends a code message to the queue regarding the volume of fluid that was dispensed. The queue is updated with the volume that dispensed to the identification information of the RFID tag and starts a timer. In a preferred embodiment the timer is 60 seconds long. Once the timer expires, or if the code message provided by the dispensing machine shows that the maximum volume has been dispensed, the identification information of the RFID tag is removed from the queue and the dispensed volume is logged in the system.

While the dispensed item described is referred to as a beverage, it is envisioned that the dispensed item can be any type of food item that can be dispensed in measured quantities. Furthermore, the system may include the VF code section and the dispensing in a single unit or they may be separate units.

FIGS. 10(*a*) and 10(*b*) provide a detailed flow chart of the actions and associated messages that are provided with another embodiment of the present invention. For the sake of brevity, a text version of the entire flow chart is not reproduced herein. However, it is to be understood that references in FIG. 10(*a*) to the upper case letters shown within quotation marks indicates that the associated background screen selection shown in FIG. 10(*b*). For example, the letter "A" indicates that the Main Screen listed by the letter A is to be displayed. Furthermore, numbers shown in quotation marks indicate a graphical user interface ("GUI") message selection shown in FIG. 10(*b*) that is to be displayed. For example, the message "UNLIMITED REFILLS UNTIL XX/XX/XX" is to be displayed for the number "2". Additionally, the characters "XX/XX/XX" represent a particular predetermined date in that case. The GUI message selection may be shown on a display screen to a user and may be shown with an appropriate or associated background screen selection from FIG. 10(*b*).

Initially, a customer may approach a machine embodying the system which displays the Main Screen for the machine. Accordingly, the customer may press a button and allow the machine to read the RFID tag which is present in an embodiment of this invention. If the customer is authorized to receive a refill, the system will provide an appropriate display that allows the customer to select a button or icon that will cause the machine to dispense a desired fluid. However, if the customer is not authorized to receive a refill, a number of optional displays may be presented to the customer by the machine. In addition, the flow chart in FIG. 10(*a*) also provides displays for situations where the maximum volume of fluid has been dispensed or where a desired product is sold out.

Patents, patent applications, publications, scientific articles, books, web sites, and other documents and materials referenced or mentioned herein are indicative of the levels of skill of those skilled in the art to which the inventions pertain, as of the date each publication was written, and all are incorporated by reference as if fully rewritten herein. Inclusion of a document in this specification is not an admission that the document represents prior invention or is prior art for any purpose.

While we have shown and described certain present preferred embodiments of our invention it is to be distinctly understood that the invention is not limited thereto but may be otherwise variously embodied and practiced within the scope of the following claims.

We claim:

1. A method for re-use of media for authorizing beverage dispensation, comprising:

reading beverage information from a re-usable medium, removably associated with a container into which beverage is dispensed, at a reader associated with a beverage dispenser; and (a) when the information authorizes dispensing a beverage:

dispensing a beverage into the container;

updating the re-usable medium with revised beverage information; and repeating the steps of reading, dispensing, and updating until the information does not authorize dispensing a beverage; and (b) when the information does not authorize dispensing a beverage:
refusing to dispense a beverage;
indicating that a beverage will not be dispense;
collecting the re-usable medium;
placing new beverage information on the re-usable medium; and
providing the re-usable medium to a person different than an immediately previous holder of the reusable medium.

2. The method of claim 1, wherein the medium is selected from the group consisting of a card, a key fob, a boot, a chip, a lanyard, and a bracelet.

3. The method of claim 1, wherein the beverage information is read from, updated to, and placed on a device selected from the group consisting of an RFID tag, a high frequency RFID tag, a bar code, a matrix code, a bokode, and a magnetic strip.

4. The method of claim 1, wherein said beverage information includes at least one member of the group consisting of time of purchase, time remaining to access beverage fills, number of beverage fills purchase, and number of beverage fills remaining.

5. The method of claim 1, further comprising, prior to the step of reading beverage information, the step of providing a customer with a re-usable medium containing beverage information.

6. The method of claim 1, further comprising displaying the revised beverage information.

7. The method of claim 1, wherein collection of the re-usable medium is accomplished through the same apparatus used to read the beverage information.

8. The method of claim 1, further comprising correlating beverage information with user information.

9. The method of claim 1, wherein said user information includes at least one member of the group consisting of user age, user sex, user income, and user's frequency of purchasing beverages.

10. The method of claim 1, further comprising displaying confirmation of collection of the re-usable medium.

11. The method of claim 1, wherein the medium is a card and the beverage information is read from, updated to, and placed on an RFID tag.

* * * * *